US005105715A

United States Patent [19]

Nordmann et al.

[11] Patent Number: 5,105,715

[45] Date of Patent: Apr. 21, 1992

[54] TANK TURRET WITH INCREASED RECOIL MASS

[75] Inventors: Adolf Nordmann, Erkrath; Wilfried Becker, Düsseldorf; Josef Metz, Neuss; Erich Zielinski; Jochen Hoff, both of Düsseldorf; Hans Hülsewies, Duisburg; Friedhelm Knörich; Wolfgang Böer, both of Düsseldorf, all of Fed. Rep. of Germany

[73] Assignee: Rheinmetall GmbH, Dusseldorf, Fed. Rep. of Germany

[21] Appl. No.: 579,632

[22] Filed: Sep. 10, 1990

[30] Foreign Application Priority Data

Sep. 11, 1989 [DE] Fed. Rep. of Germany ..... 3930256

[51] Int. Cl.[5] ..... F41H 5/20

[52] U.S. Cl. ..... 89/36.13; 89/37.07; 89/42.01

[58] Field of Search ..... 89/36.08, 36.13, 37.01, 89/37.07, 37.12, 37.14, 40.03, 42.01

[56] References Cited

FOREIGN PATENT DOCUMENTS

| | | | |
|---|---|---|---|
| 220519 | 3/1962 | Austria | 89/36.13 |
| 248670 | 8/1911 | Fed. Rep. of Germany . | |
| 826545 | 4/1938 | France | 89/37.12 |
| 220 | of 1888 | United Kingdom | 89/36.13 |
| 8654 | of 1902 | United Kingdom | 89/36.08 |

OTHER PUBLICATIONS

European Search Report.

*Primary Examiner*—Stephen C. Bentley

*Attorney, Agent, or Firm*—Spencer, Frank & Schneider

[57] ABSTRACT

A tank turret including an armored turret housing having a front side provided with solid front armor, and a pivotally mounted gun including a cradle shield, cradle, recoil device and rearward breech block housing being arranged in the turret housing. The armored turret housing, or at least parts of it, are used to increase recoil mass of the gun.

4 Claims, 3 Drawing Sheets

TANK TURRET WITH INCREASED RECOIL MASS

BACKGROUND OF THE INVENTION

The invention relates to an armored turret having an armored turret housing and solid front armor, in which a pivotally mounted gun including a cradle shield, cradle, recoil mechanism, and rearward breech block housing is disposed.

A constantly increasing projectile force is required of new types of armored guns. The result is that the load forces on the turret, and on the moving vehicle to which the turret is attached, become constantly greater and recoil travel becomes constantly longer. In order to keep the forces low and recoil travel short, the recoil mechanisms must be enlarged. However, additional weight has a disadvantageous effect on the entire concept, increasing the proportion of dead load. Therefore, it is desireable to seek to include masses of components which are already functionally present into the recoil masses. However, since many of these components are subjected to great stresses from the shock of firing and recoil, there are very few functioning elements (for example, interior equipment, optic/electronic components), which are suited for this purpose. Until the present time, recoil masses usually comprised a heavy breech ring, a heavy gun barrel, the muzzle brake, or an additional break cylinder in place of a piston rod at the breech ring. These measures, however, are not sufficient. They are not able to prevent long recoil travel. Long recoil travel makes it more difficult to balance the elements for elevation aiming. A muzzle brake influences the most often ballistically extended gun and results in a powerful nose-heavy moment. Additionally, long recoil travel and stresses from shock can prevent the supply of energy to functional elements (for example, rupture of a cable) which may possibly be attached the recoil mass.

SUMMARY OF THE INVENTION

It is therefore an object of the present invention to increase the recoil mass of an armored weapon without, however, increasing the proportion of the dead load.

The above and other objects are accomplished according to the invention in the context of a tank turret including an armored turret housing having a front side provided with solid front armor, and a pivotally mounted gun including a cradle shield, cradle, recoil device and rearward breech block housing being arranged in the turret housing, wherein the armored turret housing or at least parts of it are used to increase recoil mass of the gun.

The invention thus solves the above described problem in that functioning masses in the armored turret or the entire armored turret housing are incorporated into the recoil mass. That is, the tank turret housing or the solid frontal armor is at least in part or even in toto, including, if necessary, the cradle shield, cradle and other peripheral weapon and turret components, displaceably located on the horizontal rotation device of the tank turret housing and is fixedly connected with the pivotal gun for increasing the recoil mass in the longitudinal direction and horizontal direction of the gun.

The armor represents a large portion of the total weight of the battle tank. Most often it comprises layered or block packets which are welded into the housing. The object is to movably mount the layered or block packets, for example, by sliding planes, lever parallelogram mounting or similar means, and to connect them with the usual recoil mass and the gun and to brake them simultaneously. This solution makes it possible for the first time to increase the energy of the projectile. The type of recoil mounting may, as mentioned above, be accomplished via sliding mountings, lever mountings or other appropriate mountings. Braking the mass of the various displaceable masses may be performed (for example, centrally or off-center) by means of spring elements (annular or rubber springs) or corresponding damping elements.

The invention is further explained and described below by way embodiments shown in the drawings.

DETAILED DESCRIPTION OF THE PREFERRED EMBODIMENTS

Figure 1:
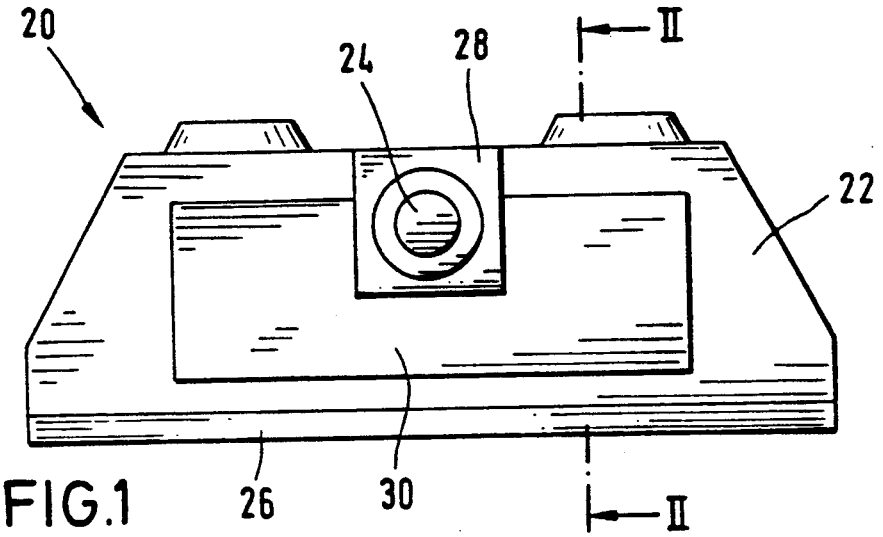
FIG. 1 a front elevation schematic of a tank turret according to the invention.
Figure 2:
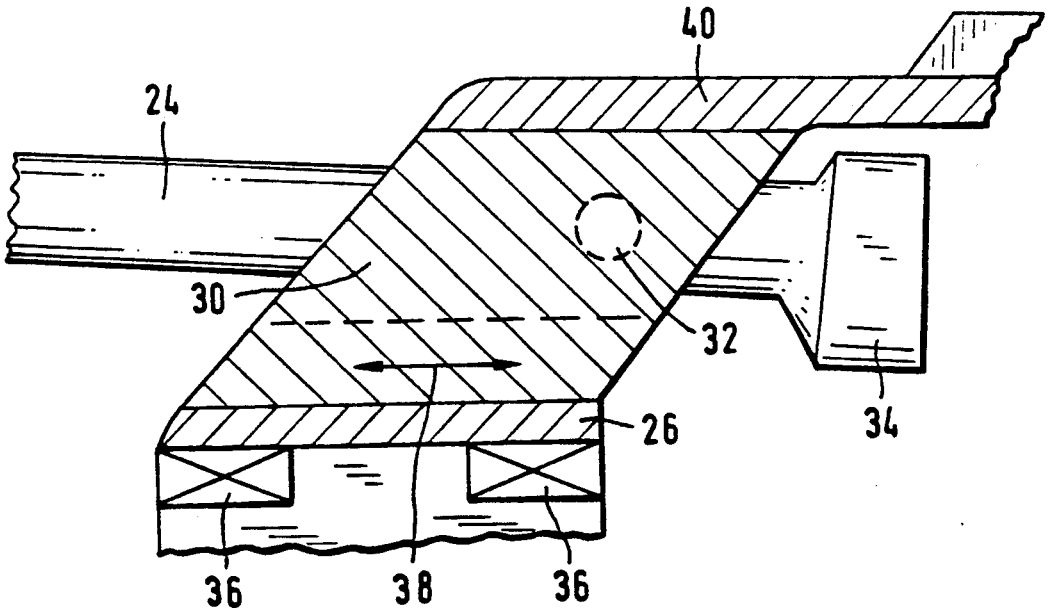
FIG. 2 is a cross section through the frontal armor of the tank turret according to line II—II in FIG. 1.

Referring to FIGS. 1 and 2, there is shown a tank turret 20 which is only shown schematically. Tank turret 20 is attached to an armored vehicle, which is not shown, i.e., it is pivotally mounted on the vehicle for rotation in a horizontal plane. At its front, tank turret 20 is provided in its tank turret housing with a solid front armor 22 in which there is arranged a vertically pivotal gun 24, along with its cradle shield 28, cradle, recoil mechanism and a rearward breech block housing 34.

A rectangular, displaceably disposed armored packet 30 is inserted into front armor 22. On the interior of armored packet 30, gun 24 is mounted on a trunnion 32 for vertical pivotal movement as may be seen in FIG. 2. Turret 20 is supported on a rotation mounting 36 which in turn is supported on a lower rotation device 26 so that the entire tank turret 20 with gun 24 is pivotally mounted to the housing of the armored vehicle (not shown) for rotation in a horizontal plane.

Armored packet 30, along with gun 24 and its breech block housing 34, undergo a horizontal recoil displacement as shown by arrow 38 within the remaining interior front armor 22 and between the armored upper roof 40 and the lower rotation device 26. Thus, in accordance with the invention, the recoil mass which is connected to the gun is considerably enlarged. The desired adjustable enlargement of the recoil mass is dependent on the size and mass, respectively, of the armored packet 30 which serves as additional recoil mass. The total mass determines the size of the effective brake force and the length of recoil travel.

Figure 4:
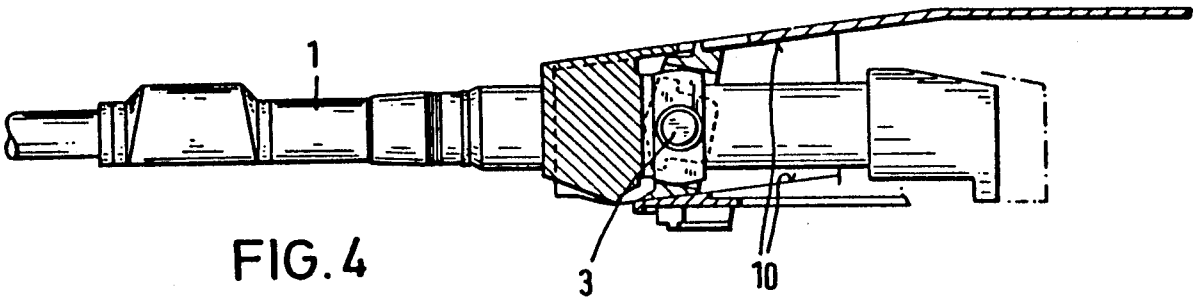
FIG. 4 is a longitudinal section through the tank turret according to FIG. 3.
Figure 3:
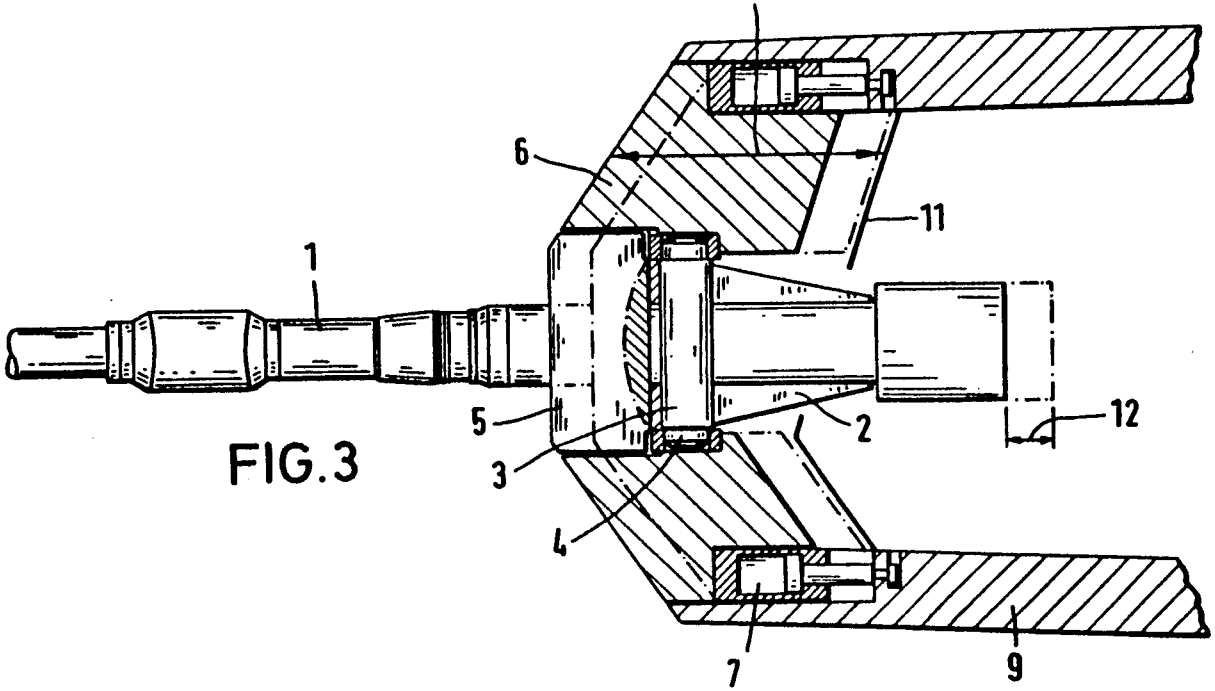
FIG. 3 a partial cross section of a further embodiment of a tank turret according to the invention.

FIGS. 3 and 4 show a further tank turret embodiment according to the invention. In this embodiment, the entire front armor is designed as a displaceably disposed block packet 6. Gun 1 is fixedly connected to a cradle tube 2 and a frontal cradle shield 5, and is disposed for pivotal displacement in the vertical direction by means of a mantelet 3 and a trunnion 4. Block packet 6 is displaceably disposed on horizontal or nearly horizontal sliding planes 10 (see FIG. 4) within the lateral walls 9 of the turret and between the roof armor and horizontal rotation device. A recoil device, comprising duplicate recoil mechanisms 7 is solidly supported by lateral turret walls 9 on opposite sides of block packet 6. During firing, the total mass comprising tube 1, cradle 2, mantelet 3, trunnion 4, cradle shield 5, block packet 6 and portions of the recoil device 7 are displaceable in a horizontal or nearly horizontal direction (as shown by arrow 38) on sliding planes 10, with vertical pressure being absorbed by means of the slidable mounting. Recoil travel is denoted by arrow 12. A protective wall 11 limits the movement of the block packet 6 towards the interior of the turret housing to protect personnel.

Due to the enlargement of the total recoil mass according to the invention, the brake force is advantageously increased and the length of recoil travel is considerably shortened.

For small tank turrets having heavy weapons and great firing capacity with high projectile energy, it is further possible according to another embodiment of the invention that the entire armored turret housing be displaceably disposed on the horizontal rotation device and used as an additional recoil mass.

Figure 5:
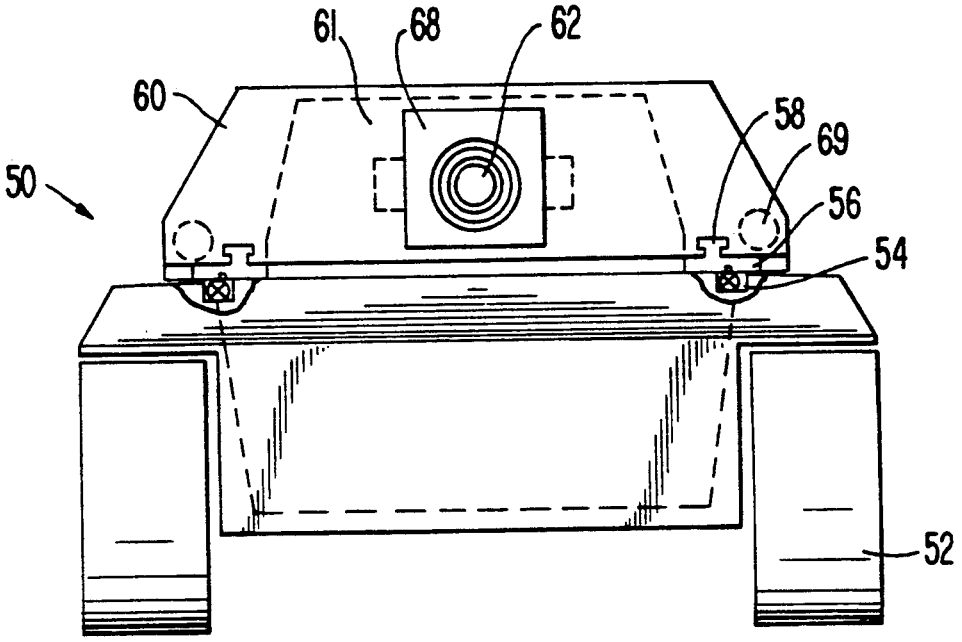
FIG. 5 is a front elevation schematic of a further embodiment of a tank turret according to the invention.
Figure 6:
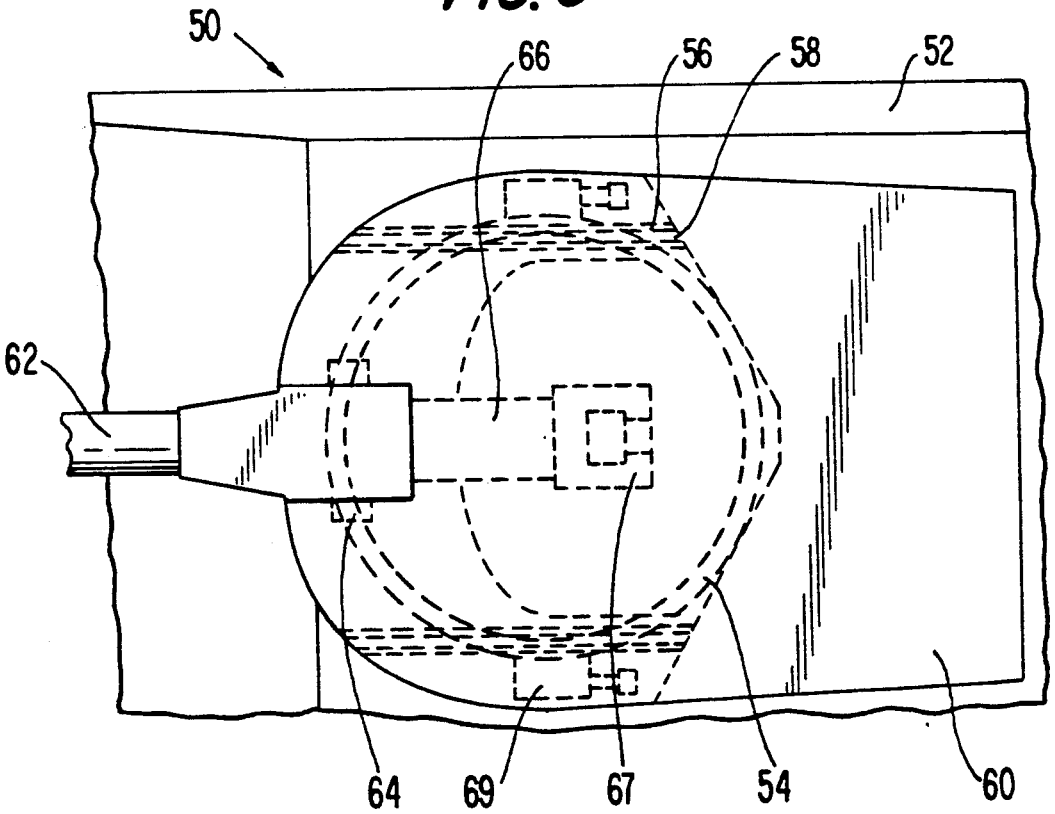
FIG. 6 is a cross section of the tank turret according to FIG. 5.

Referring to FIGS. 5 and 6 there is shown a tank 50 with a tank turret 60 and a hull 52. The hull 52 is provided with a rotation mounting device 54. Additionally an adapting plate 56 is provided, which is fixedly attached to rotation mounting device 54. The tank turret 60 is displaceably disposed on sliding guides 58 on an adapting plate 56.

According to FIG. 6 tank turret 60 is provided with a gun 62, mounted on a trunnion 64 for vertical pivotal movement and with a cradle shield 68 (FIG. 5), cradle 66, rearward breech block housing 67 and recoil device 69. In this embodiment recoil device 69 comprises two recoil mechanisms disposed between tank turret 60 and adapting plate 56.

Gun 62 with cradle shield 68, cradle 66 and rearward breech blocking housing 67 is fixedly connected to solid front armor 61 of the tank turret 60, forming a rigid unit with tank turret 60.

Contrary to the embodiment according to FIG. 3 solid front armor 61 of turret 60 is not displaceably disposed relative to the interior of the remaining armored turret housing, but the complete tank turret 60 with solid front armor 61 is displaceably disposed on sliding guides 58 of adapting plate 56. Thus tank turret 60 can be horizontally rotated versus the hull 52 to sight a target (not shown) and during firing, in accordance with the invention, the total mass of tank turret 60 moves in a horizontal direction on the sliding guides 58 of adapting plate 56. Due to this enormous enlargement of the total recoil mass according to the invention, the length of the recoil travel will be extremely shortened.

A specific example of the invention will now be described. In a combat tank, for example, a Leopard II tank, the projectile energy of a certain ammunition is estimated to be approximately 10 MJ. The recoil mass of gun, breech block housing, muzzle brake, etc., is approximately 2,500 kg up to the present time. For a recoil travel of approximately 450 mm, however, a maximum brake force of approximately 40 KN must be produced. If the projectile energy is doubled to approximately 20 MJ, and if the recoil travel were to remain the same at 450 mm, the required brake force would be approximately 1,500 KN. On the other hand, with a brake force of approximately 1,000 KN, the recoil travel would be at least 600 mm. However, these circumstances cannot be defended from a practical standpoint. The teachings according to the present invention make it possible to multiply the recoil mass from approximately 2,500 to 10,000 kg without any problem.

With the present invention and using conventional ammunition having a projectile energy of approximately 10 MJ, the maximum brake force needed to be produced with recoil travel of 450 mm remains only approximately 150 KN. For an ammunition having a two-fold projectile energy of about 20 MJ the maximum brake force needed for a recoil travel of 450 mm would only be approximately 400 KN. Expressed the other way around, if a brake force of approximately 500 KN has to be produced, the required length of recoil travel with the increased recoil mass is only approximately 335 mm.

With the increase of the recoil mass according to the invention, and if the firing performance of the projectile remains the same, it is possible to obtain a 50% reduction of recoil travel, and on the other hand with a recoil travel of 350 mm for example, it is possible to obtain a decrease by a factor of 4 in the brake force that is maximally required. Thus, ammunition having a considerably higher propelling charge energy may be fired.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A tank turret, comprising; an armored turret housing having a front side including solid front armor; and a pivotally mounted gun including a cradle shield, cradle, recoil device and rearward breech block housing arranged in the armored turret housing; wherein the solid front armor, at least in part, is fixedly attached to the gun and is displaceably disposed in the longitudinal and the horizontal direction of the gun into the interior of the remaining armored turret housing for increasing the recoil mass of the gun.

2. A tank turret as defined in claim 1, further comprising a horizontal rotation device and means for displaceably disposing the entire armored turret housing on said horizontal rotation device for increasing the recoil mass of the gun.

3. A tank turret as defined in claim 1, wherein at least the cradle shield and cradle are additionally fixedly attached to the gun for increasing the recoil mass of the gun.

4. A tank turret as defined in claim 1, further comprising a trunnion mounted in the interior of the solid front armor, the gun being mounted for vertical pivotal movement about the trunnion, and means defining substantially horizontal sliding planes and substantially vertical sliding planes within the turret housing along which the solid front armor is displaceable, and wherein said turret housing includes lateral turret housing walls and the recoil device comprises two duplicate recoil mechanisms disposed on opposite lateral sides of the front armor and being supported at least on the respective lateral turret housing walls.

* * * * *